US007874252B2

(12) United States Patent
Soto et al.

(10) Patent No.: US 7,874,252 B2
(45) Date of Patent: Jan. 25, 2011

(54) UNDERWATER GRENADE

(75) Inventors: Gabriel Soto, Ridgecrest, CA (US); Calvin Clayson, Ridgecrest, CA (US); Michael Haddon, San Luis Obispo, CA (US); Jerry Shultz, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 93 days.

(21) Appl. No.: 12/043,659

(22) Filed: Apr. 9, 2008

(65) Prior Publication Data

US 2009/0260534 A1 Oct. 22, 2009

Related U.S. Application Data

(63) Continuation of application No. 11/193,695, filed on Jul. 28, 2005, now abandoned.

(51) Int. Cl.
*F42B 22/00* (2006.01)
*F42B 27/00* (2006.01)

(52) U.S. Cl. ..... 102/412; 102/406

(58) Field of Classification Search ..... 102/390–392, 102/399, 406–410, 412–415, 482; 89/5
See application file for complete search history.

(56) References Cited

U.S. PATENT DOCUMENTS

| | | | | |
|---|---|---|---|---|
| 1,683,692 | A * | 9/1928 | Ogden | 102/392 |
| 2,966,849 | A * | 1/1961 | Joiner | 181/116 |
| 3,015,270 | A * | 1/1962 | Domingos, Jr. et al. | 102/392 |
| 3,476,048 | A * | 11/1969 | Barr et al. | 102/399 |
| 3,532,057 | A * | 10/1970 | Aubrey | 102/229 |
| 3,559,580 | A * | 2/1971 | Lyon | 102/408 |
| 3,712,218 | A * | 1/1973 | Fay | 102/216 |
| 4,160,411 | A * | 7/1979 | Weber et al. | 181/142 |
| 4,911,058 | A * | 3/1990 | Andersson et al. | 86/22 |
| 6,460,460 | B1 * | 10/2002 | Jasper et al. | 102/201 |
| 6,530,325 | B2 * | 3/2003 | Shapiro et al. | 102/302 |
| 6,802,260 | B2 * | 10/2004 | Woodall et al. | 102/408 |

* cited by examiner

*Primary Examiner*—David J Parsley
(74) *Attorney, Agent, or Firm*—Christopher L. Blackburn; Brian F. Drazich; Charlene A. Haley

(57) ABSTRACT

An underwater grenade and a method for using an underwater grenade. A depth activated, hand emplaced ordnance utilizing safe and arm technology to address underwater threats (such as enemy swimmers) while providing a safe interface with personnel. The grenade is armed after a sequence of events have occurred including reaching a desired depth and a desired passage of time. Failure of any of the events to occur will cause the grenade to be rendered safe.

23 Claims, 2 Drawing Sheets

UNDERWATER GRENADE

STATEMENT REGARDING FEDERALLY SPONSORED RESEARCH OR DEVELOPMENT

This application is a continuation of U.S. patent application Ser. No. 11/193,695, filed Jul. 28, 2005, now abandoned.

BACKGROUND OF THE INVENTION

Ships may be vulnerable to attack from underwater swimmers. In order to defend from this threat anti-swimmer weapons such as the MK3A2 concussion grenade, small arms, .50 caliber machine guns, and ship sonar is used. Unfortunately conventional grenades have fixed time delay fuses (approx. 4 to 5 seconds) and will detonate at various depths depending on how long the grenade is held after activation, the height above the water the grenade is dropped from and how far the grenade is thrown. The MK3A2 has a limited lethal radius and is no longer in production. Although fragmentation hand grenades may be used, they are less effective in water than grenades that release pressure. Guns may be used to engage an attacker at long ranges in air but their projectiles only penetrate water to a depth of a few feet. Ship sonar powerful enough to disrupt a swimmer also affects underwater work in a large radius around the ship. Conventional grenades have inherent safety risk as well. Grenades may be dropped in the ship before thrown, harming personnel. There is a need for a safe, accurate grenade for defense from underwater attack.

DESCRIPTION OF THE EMBODIMENTS

Before explaining the disclosed embodiments of the present invention in detail it is to be understood that the invention is not limited in its application to the details of the particular arrangement shown since the invention is capable of other embodiments. Also, the terminology used herein is for the purpose of description and not of limitation. In the figures, the same reference numbers are used to identify the same components.

Embodiments of the invention include an underwater grenade and a method for using an underwater grenade. Embodiments of the invention include a depth activated, hand emplaced ordnance utilizing safe and arm technology to address underwater threats (such as enemy swimmers) while providing a safe interface with personnel. The grenade is armed after a sequence of events have occurred including reaching a desired depth and a desired passage of time. Failure of any of the events to occur will cause the grenade to be rendered safe (a dud). Embodiments of the invention meet a need for safer, hand emplaced, underwater ordnance.

Figure 1:
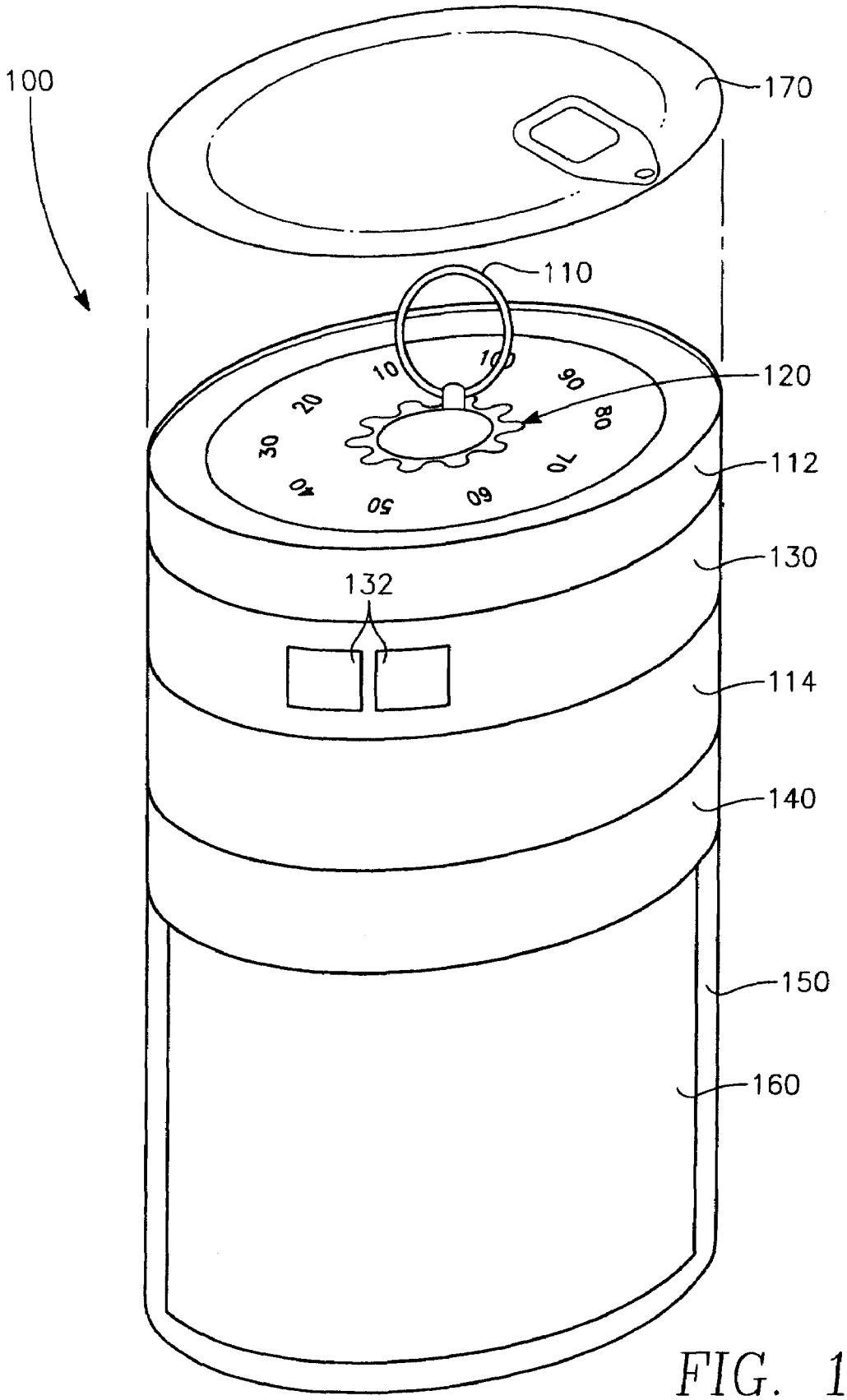
FIG. 1 illustrates an underwater grenade according to an embodiment of the invention.

FIG. 1 illustrates an underwater grenade according to an embodiment of the invention. A grenade 100 is constructed in a casing having a plurality of sections coupled together within the casing as a unitary structure. The sections may be selected and coupled so as to achieve a desired result. It is noteworthy that additional sections may be added to change the desired results (such as adding more explosives or adding a section with means for recovering unexploded grenades such as a homing beacon).

An interface section 112, within the casing and coupled to the other sections, is utilized to interface with personnel operating the grenade 100. The interface section 112 includes a means for tamper protection, such as having a sealed pop-top lid 170, pull tabs or grab loops. The interface section 112 includes a means for selecting a detonation depth wherein personnel may adjust a depth select switch (dial) 120 so as to set a depth (underwater) for the grenade 100 to explode. A means to effect the operation of the grenade includes a pull pin ring 110 to be removed by personnel. The pull top seal 170 shall be removed and the depth select switch 120 shall be set prior to pulling the pin 110. When the pin is pulled, a pair of switches interrupting both the positive and negative side of the battery 132 are closed in a power supply section 130 and power is applied to the electronics, thereby powering up the grenade, (interior electronics not shown) A pair of voltage regulators supply power for the arming logic circuitry and the high voltage convertor. The energy for the high voltage convertor is interrupted by the pressure switch and the two electrical switches (The electrical switches are referred to as 'static switch' and 'dynamic switch' in the block diagram. The dynamic switch must be cycled on and off continuously to enable the high voltage conversion process).

A safe and arm logic section 114 includes means for sensing initial environmental conditions, means for sensing subsequent environmental conditions, and means for determining whether a plurality of conditions are met for arming of the grenade 100. Upon removal of the pull pin ring 110 and powering up, the initial existing environmental conditions are inputted to the section such as the atmospheric pressure, the desired depth setting, and whether the system clock is working.

For arming and detonation to occur a plurality of conditions or sequence of events must be met. Failure to meet the conditions and sequence of events (such as dropping the grenade in the boat) will cause the grenade 100 to be rendered safe. Once these conditions are met, the safe and arm logic section 114 enables the high voltage converter and provides energy to the initiating section 140. Once armed, an output/power is provided to the initiating section 140 at the preselected depth. In one embodiment the grenade 100 may be set to detonate at depths between 10 and 100 feet. Depth is determined by use of a commercially available pressure transducer (such as Honeywell's stainless steel isolated pressure sensors) as known in the art. In the event of a failure of the pressure transducer, a backup delay timer controls initiation. The backup delay time is determined individually for each depth setting.

In one embodiment, an initiating section 140 includes a fireset including a high voltage capacitor, high voltage switch, and initiator. By using a low energy exploding foil initiator (EFT) the explosive train can be made 'in-line', thus eliminating moving parts. In one embodiment, when the desired depth is reached the fireset is electrically charged. This allows the fireset to be self-triggering (through the use of a breakdown switch), thus reducing the number of parts and the cost while increasing reliability. Once the voltage on the firing capacitor exceeds the breakdown voltage on the breakdown tubes, the energy stored in the capacitor is discharged into the detonator, thus detonating the explosive charge.

An explosive section 160 contains a secondary explosive compound optimized for underwater use, where the creation of expanding gases is a key characteristic (such as PBXN-109). This explosive is contained within a liner 150 for materials compatibility and mechanical properties. In another embodiment a liner 150 may be omitted if the casing material is suitable for the explosive.

Figure 2:
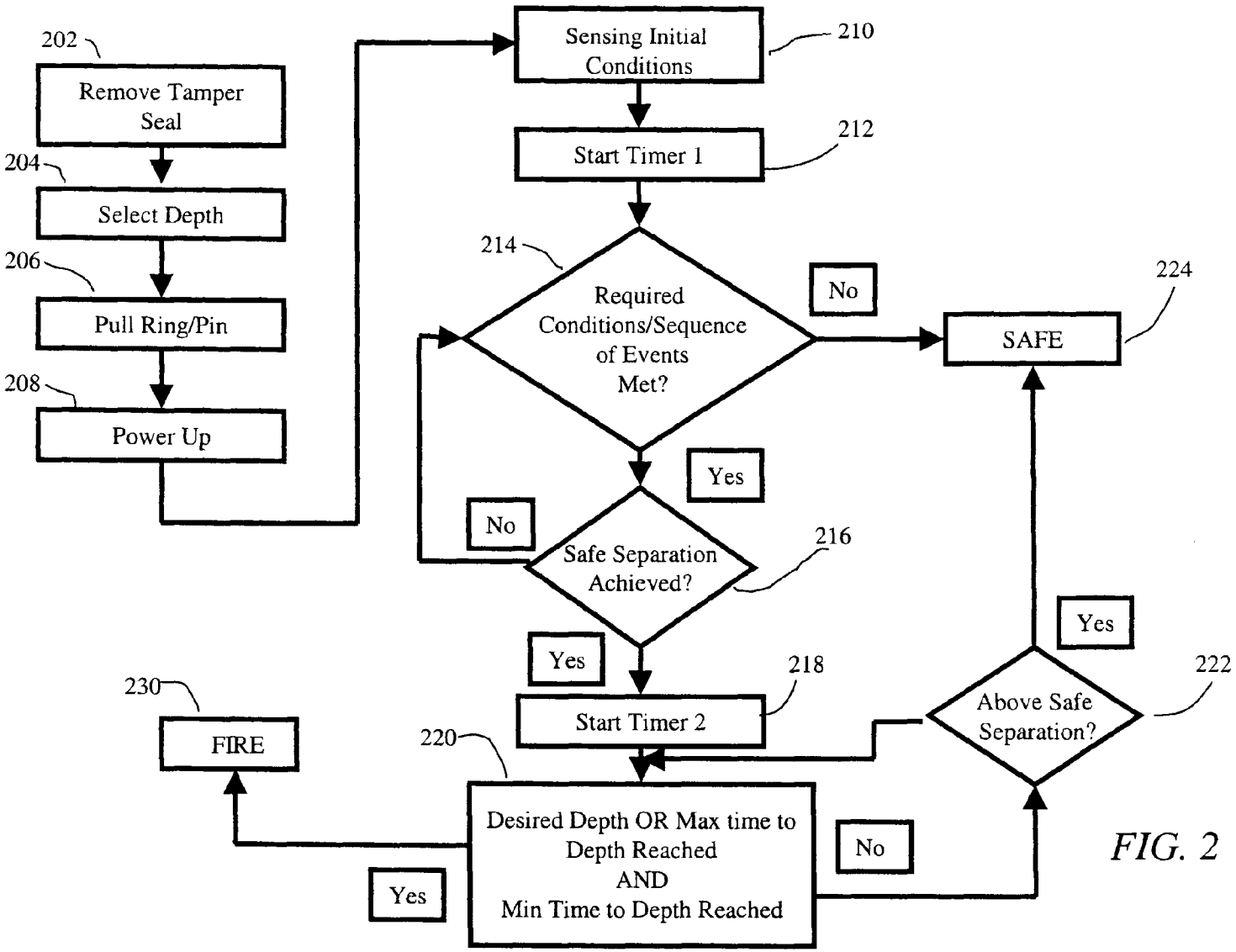
FIG. 2 is a functional flow chart of the operation of an underwater grenade according to an embodiment of the invention.

FIG. 2 shows a functional flowchart of the operation of one embodiment of the grenade 100. Referring to FIGS. 1 and 2, a pop-top 170 or seal for tamper protection is opened 202 allowing access to the grenade 100. The depth is selected 204 utilizing a dial set to a desired number of feet under water. A mechanical interlock prevents pulling pin 110 prior to setting depth 120.

The pull ring and pin is pulled 206 and allows power to flow 208 from the power supply section 130 and is applied to the grenade electronics. During power up, the arming logic is initialized and the switch setting of the depth dial is latched. The latched value is decoded into a maximum and a minimum fire time as well as a pressure sensor threshold value for the selected depth. As part of a power up test the initial existing environmental conditions are sensed 210, such as a valid depth selected, clocks and pressure sensors being operational, and the position of switches. In an embodiment of the invention, upon power up the grenade safe and arm logic section:

a) Verifies proper operation of system clock.

b) Latches depth setting and verifies setting is valid.

c) Verifies pressure sensor is within expected range (for example at sea level). If reading is within expected range depth is zeroed (measured pressure is treated as zero depth). If reading is out of range the unit is rendered safe (placed in a condition in which arming is no longer possible).

d) Verifies static switch drive is inactive.

e) Verifies pressure switch open assuring that grenade has reached a minimum depth such as 7 ft.

f) Starts timers.

A first timer 212 begins a countdown to a desired number of seconds. When the grenade is still not thrown into water by the end of the time period the grenade is rendered safe. After grenade emplacement into the water, current conditions are continually sensed and compared to required conditions and required sequence of events 214 so as to determine whether or not to continue towards arming the grenade. For example, in an embodiment of the invention the safe and arm logic section monitors the pressure switch and sensor via a digital circuit. At the same time, a separate analog circuit in the safe and arm logic section is performing similar checks. The analog circuit is composed of discrete components; resistors, capacitors, and comparators. This circuit is looking for the closure of the pressure switch prior to the sensing of 10 feet. If this sequence is detected, the electrical static switch is closed.

In one embodiment, the first timer (timer 1) is started 212 and sequence checking circuit 1 and 2 monitor the output of the pressure switch, the pressure sensor, and timer 1 to determine if the pressure switch and the pressure sensor detect water pressure in the proper sequence and in the proper time window (between 1 and 15 seconds after power-up). The pressure switch is designed to close at approximately 7 ft of water. The grenade is placed in the safe position if: 7 ft depth (pressure switch output) is sensed before 1 second or if 10 ft depth (pressure sensor output) is not reached within 15 seconds. Otherwise, the unit commits towards arming if it is determined that the fall rate is less that a predetermined value during the 7 ft to 10 ft range. When the required conditions are not met 214 the grenade is rendered SAFE 224.

When the required conditions are met 214 an additional test is made to ensure there is a safe separation 216 distance from the emplacement location (such as a ship). In one embodiment, the pressure sensor reading is compared to the expected value for 10 feet of water. Therefore, the logic expects to see the switch close prior to the sensor indicating 10 feet. If both sequence checks pass, timer 2 is started and the output for driving the dynamic switch is enabled (but not activated). The second timer begins to count 218 and the time to reach the desired depth is continuously sensed. If the grenade is within its proper fall rate, it will function on depth. If the unit falls either too fast or too slow it will function on time. In one embodiment, if the desired depth is reached OR the max time to reach the desired depth, AND the minimum time to reach desired depth 220 has passed then power will be supplied to the detonator and the grenade shall FIRE 230. This ensures the grenade shall not fire too early. In addition, if for some reason the grenade has risen above the safe separation depth 222 the grenade will be rendered SAFE 224. When the proper environmental conditions have been sensed, energy is supplied to arm and fire the explosive charge 230.

Another embodiment of the invention includes a method for defending against underwater attackers including: providing a grenade for underwater application with a plurality of sections enclosed within a casing; at least one interface section within the casing, coupled to the plurality of sections, having means for tamper prevention, means for selecting a detonation depth, and means to effect the operation of the grenade; at least one power supply section within the casing, coupled to the plurality of sections; at least one safe and arm logic section within the casing, coupled to the plurality of sections, having means for sensing initial environmental conditions, means for sensing subsequent environmental conditions, and means for determining whether a plurality of conditions are met for arming of the grenade; at least one initiating section within the casing, coupled to the plurality of sections, including a safe and arm device, and at least one explosive section within the casing, coupled to the plurality of sections, containing an explosive compound. The method further includes setting a plurality of desired detonation conditions to be met prior to detonation of the grenade on the grenade and dropping the grenade amongst the underwater attackers.

It is to be understood that the foregoing detailed description is exemplary and explanatory only and is not to be viewed as being restrictive of embodiments of the invention, as claimed. The invention is capable of other and different embodiments, and its several details are capable of modifications in various obvious respects, all without departing from the invention. Accordingly, the drawings and description are to be regarded as illustrative in nature, and not as restrictive. Thus the scope of this invention should be determined by the appended claims, drawings and their legal equivalents.

What is claimed is:

1. A grenade for underwater application comprising:

a casing;

an interface section disposed within said casing having a tamper prevention device, and manually setting device, for setting at the time of grenade operation, the detonation depth from a plurality of selectable depths within a predetermined range;

a depth pressure activated safe and arm logic section disposed within said casing, operatively coupled with said interface section, having sensing initial environmental conditions device, sensing subsequent environmental conditions, detecting and determining water depth via sensing of environmental pressure for both arming and firing, and determining whether a plurality of conditions for arming said grenade are satisfied;

an initiating section disposed within said casing operatively coupled with said depth pressure activated safe and arm logic section, said interface section, and an explosive section;

said explosive section, including an explosive charge, disposed within said casing;

a power supply section disposed within said casing, operatively coupled with said initiating section, said depth pressure activated safe and arm logic section, and said interface section;

said initiating section operative to arm said explosive section when predetermined conditions for arming said grenade are satisfied; and said initiating section operative to detonate said armed explosive section when said manually set detonation depth is reached.

2. The grenade of claim 1 wherein said means for tamper prevention includes a pop top lid seal.

3. The grenade of claim 1 wherein said means for manually setting the detonation depth includes a manual dial on said grenade for selecting a detonation depth from at least about 10 feet to about 100 feet.

4. The grenade of claim 1 wherein said means to initiate the operation of said grenade includes a pull ring removably affixed to said grenade.

5. The grenade of claim 1 wherein said at least one power supply section includes batteries and voltage regulators.

6. The grenade of claim 1 wherein one of said plurality of sections includes additional explosives.

7. The grenade of claim 1 further comprising means for locating and retrieving said grenades should it fail to detonate.

8. The grenade of claim 1 wherein said environmental pressure is measured by said device, sensing environmental pressure includes said pressure transducer, for pressure measurements and logic for comparing the measurement to said fixed safe separation depth and to the firing depth.

9. A method for defending against underwater attack comprising:

providing a submersible grenade for underwater application having enclosed within a casing an interface section, a depth pressure activated safe and arm logic section, an initiating section, and an explosive section including an explosive charge;

providing operative coupling between each said section enclosed within said casing;

providing within said interface section a tamper prevention device, a device for manually selecting a detonation depth, and to initiate the operation of said grenade;

setting the grenade denotation depth manually at the time of grenade operation by said device for manually selecting a detonation depth of said interface section;

providing a power supply within said casing, operatively coupled to each said section enclosed within said casing;

providing within said depth pressure activated safe and arm logic section, a sensing initial environmental conditions device, a sensing subsequent environmental conditions device, detecting and determining water depth via sensing of environmental pressure for both arming and firing, and determining whether a plurality of predetermined conditions for arming said safe and arm logic section are satisfied;

submersing said grenade adjacent said attackers;

arming said safe and arm logic section when said predetermined conditions for arming said safe and arm logic section are satisfied;

activating said initiating section when said armed safe and arm logic section senses said manually set detonation depth; and activating said explosive section when said initiating section is activated to detonate said explosive charge.

10. The method of claim 9 wherein said means for tamper prevention includes a pop top lid seal.

11. The method of claim 9 wherein said means for manually selecting a detonation depth includes a manual dial located on a top of said grenade for manually selecting a detonation depth from at least about 10 feet to about 100 feet.

12. The method of claim 9 wherein said means to initiate the operation of said grenade includes a pull ring located on a top of said grenade.

13. The method of claim 9 wherein said at least one power supply section includes batteries and voltage regulators.

14. The method of claim 9 wherein one of said plurality of sections includes additional explosives.

15. The grenade of claim 9 wherein one of said plurality of sections includes a means for retrieving or locating unexploded grenades.

16. The method of claim 9, wherein said environmental pressure is measured by said device, sensing environmental pressure includes said pressure transducer for pressure measurements and logic for comparing the measurement to said fixed safe separation depth and to the firing depth.

17. A submersible anti-swimmer grenade comprising:

a hollow casing;

a pressure transducer adapted to provide an output representative of external depth pressure disposed within said casing;

said pressure transducer operably coupled with a safe and arm logic device disposed within said casing;

said safe and arm logic device having a manually selectable depth pressure threshold setting for manually selecting the depth pressure threshold setting at the time of operation of the submersible grenade;

said safe and arm logic device operably coupled with an initiating section including a self-triggering fireset disposed within said casing;

said fireset operably coupled with an explosive charge disposed within said casing;

said pressure transducer, said safe and arm logic device, and said initiating section each operably coupled with an electrical power supply disposed within said casing;

said safe and arm logic device adapted to cause operation of said initiating section in response to said pressure transducer output corresponding to the manually selected depth pressure threshold setting, pressure is measured by said device, sensing environmental pressure includes said pressure transducer for pressure measurements and logic for comparing the measurements to a fixed separation depth and to a firing depth; and said fireset operable to cause explosive charge detonation upon operation of said initiating section.

18. The grenade of claim 17 further comprising:

an electrical power supply switch adapted upon operation to energize the pressure transducer, safe and arm logic device, and initiating section.

19. The grenade of claim 17 further comprising:

a timer operably coupled with said electrical power supply and with said safe and arm logic device;

said safe and arm logic device adapted to permit operation of said initiating section between two selectable times.

20. The grenade of claim 17 further comprising:

a timer operably coupled with said electrical power supply and with said safe and arm logic device;

said safe and arm logic device adapted to permit operation of said initiating section after a predetermined time interval has elapsed.

21. The grenade of claim 19 or claim 20 further comprising:

an electrical power supply switch adapted upon operation to energize the pressure transducer, safe and arm logic device, initiating section, and timer.

22. The grenade of claim 17 further comprising means for manually selecting a detonation depth from at least about 10 feet to about 100 feet.

23. A submersible grenade for underwater application comprising:

a casing;

a plurality of sections disposed within said casing;

said plurality of sections including a power supply section operatively coupled with an interface section, a depth pressure activated safe and arm logic section, an initiating section, and an explosive section;

said interface section having a tamper protection device and means to at the time of grenade operation manually select, within a predetermined range, the grenade detonation depth;

said interface section operatively coupled with said depth pressure activated safe and arm logic section;

said depth pressure activated safe and arm logic section including a sensing depth pressure device, pressure is measured by said device, sensing environmental pressure includes a pressure transducer, for pressure measurements and logic for comparing the measurements to a fixed safe separation depth and to a firing depth and determining whether predetermined conditions for arming said grenade are satisfied;

said initiating section operatively coupled with said depth pressure activated safe and arm logic section;

said explosive section, including an explosive charge, operatively coupled with said initiating section; and said initiating section operative to initiate detonation of said explosive charge when conditions for arming said grenade are satisfied and said manually selected detonation depth is reached.

* * * * *